United States Patent [19]

Jeane

[11] Patent Number: 4,976,052

[45] Date of Patent: Dec. 11, 1990

[54] TOWED, POWERED, LAND GRADER

[76] Inventor: George C. Jeane, P.O. Box 23, Evans, La. 70639

[21] Appl. No.: 406,722

[22] Filed: Sep. 12, 1989

[51] Int. Cl.[5] ..... E02F 3/78

[52] U.S. Cl. ..... 37/109; 37/189; 37/DIG. 13; 172/78; 404/90; 404/122

[58] Field of Search ..... 37/108 R, 108 A, 109, 37/110, 111, 112, 113, 114, 189, DIG. 13; 172/63, 65, 73, 78, 108; 404/90, 91, 122

[56] References Cited

U.S. PATENT DOCUMENTS

| | | | |
|---|---|---|---|
| 1,120,179 | 12/1914 | Bleuns | 37/109 |
| 1,182,067 | 5/1916 | Whittell | 37/189 |
| 1,525,262 | 2/1925 | Austin | 172/63 X |
| 1,945,733 | 2/1934 | Court | 172/78 |
| 3,443,326 | 5/1969 | Saumenig | 37/189 |
| 4,624,197 | 11/1986 | Drake | 172/63 |

*Primary Examiner*—Randolph A. Reese
*Assistant Examiner*—Arlen L. Olsen
*Attorney, Agent, or Firm*—Alexander F. Norcross

[57] ABSTRACT

A land grader for grading an unprepared or partially prepared soil surface, as a step in the preparation of a roadbed. The land grader has a frame fixed at a forward end to the tractor and is supported at a rearward end to a plurality of tamping wheels. On the frame are mounted a plurality of rotary cutters which are offset laterally and axially from one another along an angle to the direction of travel. The rotary cutters have scraper blades mounted between them.

7 Claims, 3 Drawing Sheets

TOWED, POWERED, LAND GRADER

BACKGROUND OF THE INVENTION

This invention relates to the field of land graders or towed plows, of the type towed behind a tractor for active scraping, and levelling of unprepared soil or partially prepared soil, as a step in the preparation of a roadbed.

The use of powered cutters in such a device is known. For instance, U.S. Pat. No. 3,693,722 to Brown discloses a grading blade which includes parallel rotary cutters suspended transversely to a grading vehicle, such as a motor grader.

The cutters in Brown rotate around an axis transverse to the direction of travel of the grader.

U.S. Pat. No. 3,841,006 to Mironov, et al discloses a towed rotary cutting head particularly suited for terracing or cutting terraces. The cutting head is mounted forward on a heavy tractor. Again the cutting blades rotate around an axis transverse to the actual cut.

U.S. Pat. No. 4,342,162 to Spaans, et al disclose an elongate soil preparation or ground material planing device in which an elongate auger having a helical blade is used to laterally move soil.

U.S. Pat. No. 3,999,314 to Miller, et al discloses a rotating cutting tool and a method of suspending the same from an articulated prime mover.

U.S. Pat. No. 3,767,262 to Pentith discloses the use of a rotating tooth drum for removing a paved road surface.

U.S. Pat. No. 3,638,539 to Lewis discloses a road base grader utilizing in combination a helical transverse auger and a plurality of rotating scarifiers. The auger laterally displaces material loosened by the rotating scarifiers.

SUMMARY OF THE INVENTION

The invention is built as a very heavy main frame forming a towed box, containing a number parallel, laterally offset combinations of a feed scraper blade which feeds spoil into a transverse rotary cutter wheel. There is at the lead end of the grader an initial side scraper to feed into the first, forward cutter wheel. Between each of the cutter wheels, extending from behind a forward cutter wheel to in front of the next offset cutter wheel is a scraper blade, at a level above ground so that it is slightly above the lowest level of its adjacent cutter wheels and angled so as to feed material from behind one cutter wheel into the front of the next cutter wheel. A final scraper blade, extending from behind the last cutter wheel, extends out through an opening in the grader box, depositing material in a row offset from the path graded by the invention.

Each rotary disk cutter is a wheel mounted on a shaft supported between a front and a rear pillow bearing, belt driven through a belt wheel behind the rear pillow bearing, in turn driven from a shaft which runs forward, and connects to the power takeoff unit on a towing tractor. Each cutter wheel has four flanged or web front reinforcing sections which prevent the wheel from being bent backwards by cutting loads, and which help to push aside the material as the wheel cuts. The wheels or cutter disks are of heavy, high inertia construction, producing a "flywheel" effect which helps maintain rotary velocity under impact loads. Teeth are constructed on the outer periphery of the wheel as angled diamonds.

A grader blade is positioned behind each rotary disk cutter and angled so as to grade material from the more forward rotary disk cutter into the center of the next rearward rotary disk cutter. A mechanism is provided to raise and lower these grader blades in order to be able to set the depth of the cut of each blade. The angle of each blade is established by the fore and aft offset of each successive rotary cutter.

An important part of the invention is the rear wheel elevation mechanism. The grader is towed from a single point hitch on the rear of a tractor. The rear wheels, which are mounted side by side to give a tamping roller effect, are mounted on an axle, which is in turn connected to a box frame which pivots in its middle against the rear of the grader and which is activated by a hydraulic actuator. Moving the actuator fore and aft acts effectively to raise and lower the wheels and, therefore, raise and lower the rear of the grader. Since the grader is being raised or lowered from the rear, it is at an angle with the ground and the rearmost cutter is raised or lowered more than the front most cutter. As a result, moving the wheels forward and backwards provides an actual slope in the cut and therefore, sets an angle to create the crown of a roadbed.

In use, the invention is typically used in conjunction with a motor grader to do the initial preparation on a roadbed surface over unprepared ground, although in the absence of major obstructions requiring the strength of a motor grader, such as boulders, the device may be used alone, without other preliminary preparation for the initial soil grading.

It is found that the action of the rotary cutters pulverizes and scarifies the soil at the same time that it separates light organic debris such as plants, limbs and branches from actual soil constituents such as dirt and rocks. The light debris is thrown or expelled by the rotary action of the cutters while the heavier scarified spoil, soil and rocks, as it drops below this lighter debris, is smoothed and shaped by the action of the grader blades. Thus, it is found in use that the device forms a desirable combination of road bed grading, pulverizing and leveling suitable soil constituents for forming a roadbed base, while separating and expelling unsuitable organic debris for subsequent removal.

It is thus an object of the invention to provide a powered, towed device which acts to remove organic debris such as roots, limbs, plants, straw, and leaves from dirt roadbeds to facilitate the proper maintenance of these roadbeds.

It is a further object of the device to disclose a towed land grader having a unique capability of breaking up and pulverizing roadbed debris.

It is a further object of this invention to provide a powered scarifying device of greater efficiency than the prior art attachments to powered motor grader.

It is a further object of this invention to provide a device that in a single unit scarifies and grades a roadbed while moving undesirable debris to one side, depositing the same in a "wind row" to facilitate its removal.

It is a further object of this device to, in conjunction with the removal of organic debris, to compact and grade a soil surface, stabilizing the remaining roadbed material.

These and other objects of the invention may be more clearly seen in the detailed description of the preferred embodiment which follows.

DETAILED DESCRIPTION OF THE PREFERRED EMBODIMENT

Figure 1:
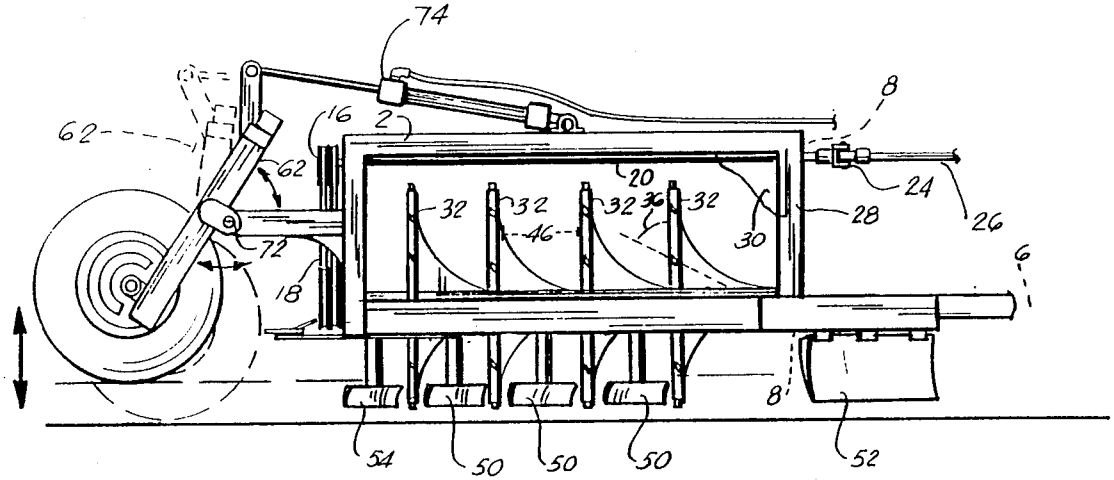
FIG. 1 is a side view of the invention with panels removed.
Figure 2:
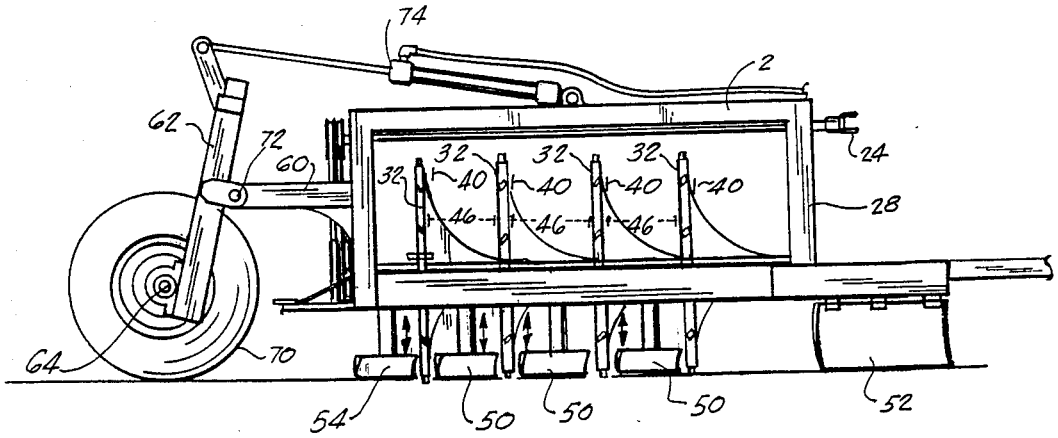
FIG. 2 is a side view of the invention, as lowered.
Figure 3:
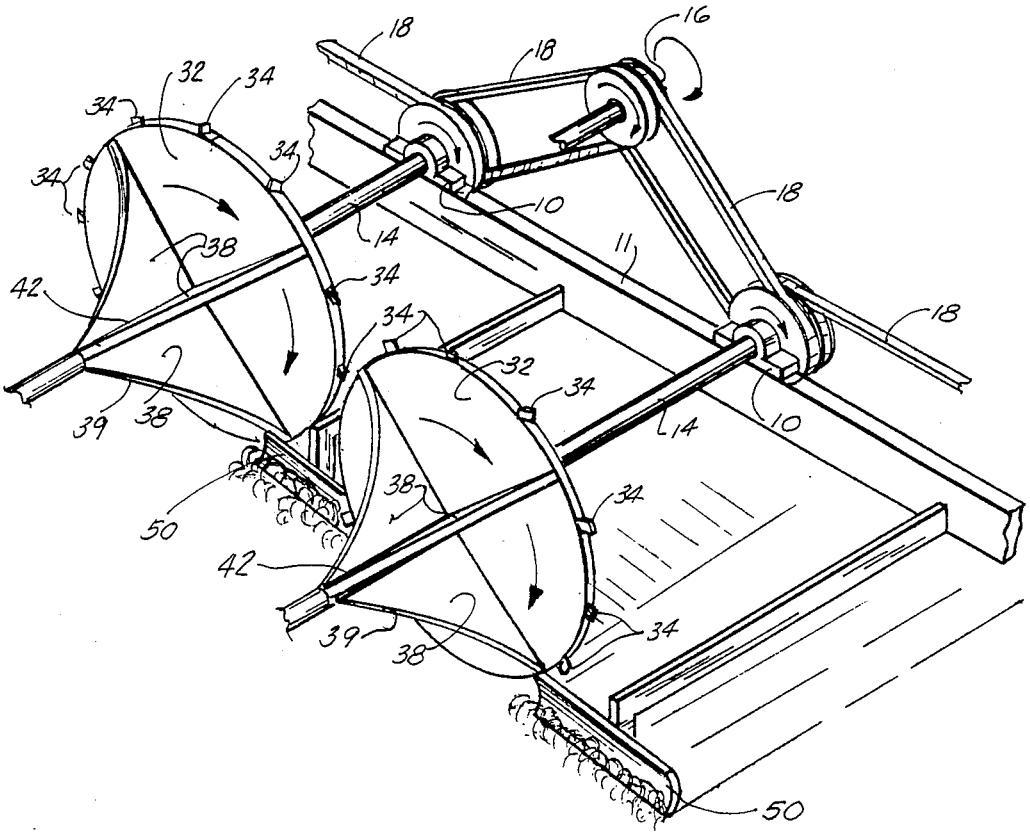
FIG. 3 is an oblique view of the cutter disks.
Figure 4:
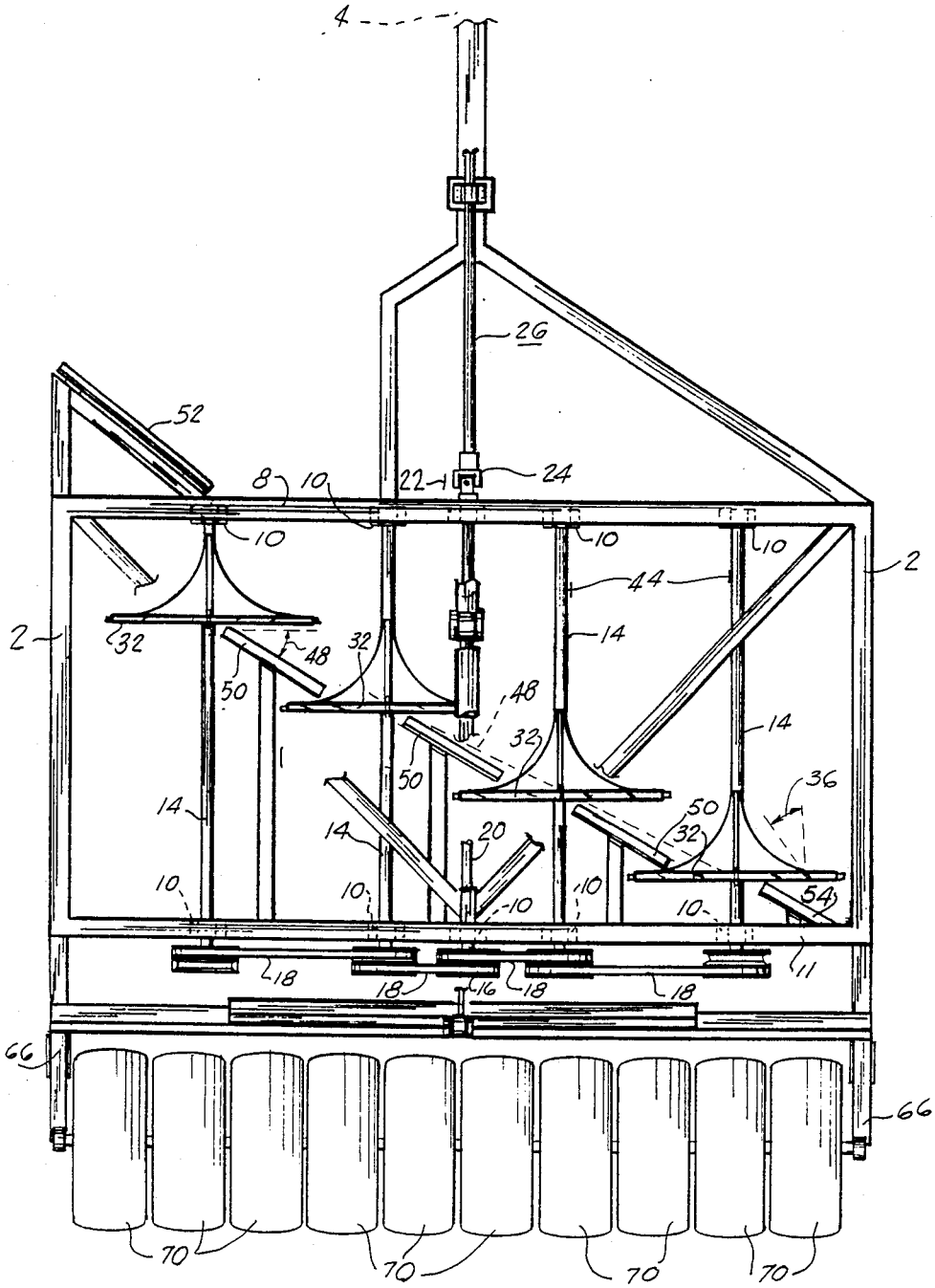
FIG. 4 is a top view of the invention, with panels removed.

Referring to the drawings, the apparatus of the invention is shown, in its preferred form, in the form of a towed attachment to a tractor having a power takeoff. The land grader takes the exterior form of rectangular frame member 2 attached through a front attachment hitch 4 to the existing three point hitch 6 of a tractor.

The rectangular frame member 2 is formed as an essentially rectangular box of substantial strength. Along a transverse front beam are periodically positioned a series of pillow block bearings. Along a parallel rear beam 12 are likewise positioned pillow block bearings 10, in line with the pillow block bearings 10 of the transverse front beam 8. Journaled for rotation within each fore and aft pillow block bearing 10 is a cutter axle 14. Cutter axle 14 is provided with a driving means 16 for rotating the axle. In the preferred embodiment, the driving means 16 is a belt driven wheel driven by driving belts 18, all of which are driven by a power takeoff extension 20. This power takeoff extension 20 is of a design obvious to those of skill in the art of tractor accessories, comprising a rotating axle connected at its forward end 22 through a universal joint 24 to the power takeoff 26 of the tractor.

Upper and lower side brace beams 28 interconnect the transverse front beam 8 and the parallel transverse rear beam 12 forming the overall rectangular frame member 2. Each of these beams is of a substantially heavy construction, designed to withstand significant impact forces and loading during the use of the grader.

The entire grader in use is covered with external panels (not shown for clarity) of heavy gauge sheet metal designed to enclose the sides and upper surface of the rectangular frame member, for the purposes of protecting operators and others during the actual operation of the grader.

Within the grader each of the parallel cutter axles 14 drives a transverse rotary cutter disk 32.

Each of transverse rotary cutter disks 32 is a substantially large disk of a heavy gauge steel welded for strength to its respective cutter axle 14. The cutter disk defines a bottom tangent line 48, and each of the cutter disks 32 are of uniform diameter so that they define a single bottom tangent line 48. Each culler disk is made relatively thick, for strength and to create inertia, so that each cutter, when rotated, exhibits a flywheel effect.

Along the outer circumference of each of the cutter disks 32 are provided cutting teeth 34, preferably of a diamond shape. These teeth are canted through the long axis of the diamond with respect to the align of diameter of the cutter disk, and this defines an angle of cut 36 of each of the teeth 34.

Each of the cutter disks is further reinforced and affixed to its cutter axle 14 by means of a plurality, preferably for, reinforcing webs 38. Each of reinforcing webs 38 is a plate of structural steel welded at one edge to the face 40 of the cutter disk 32 and welded along a second line of attachment 42 to the cutter axle 14. The reinforcing web outer edge 39 is preferably provided with an inward curve.

The spacing of the pillow block bearings 10 is such that the cutter axles 14 are parallel to one another and spaced an offset distance apart 44 less than the diameter of the cutter disks 32. Each cutter disk 32 is then spaced upon its respective axle 14 so as to define a uniform forward and aft overlap 46 between any two adjacent cutter disks. Overlap 46 extends in the direction of travel of the rectangular frame member 2, defining this direction of travel as extending in the direction of the front axle hitch 4. The overlap 46 is uniform, each successive cutter disk 32 being spaced an equal distance back from its left hand member and an equal distance forward of its right hand member. It is preferred that the direction of overlap 46 be such that, in the sense of the forward direction of the grader, the most forward cutter disk 32 is in the front left and the most rearward cutter disk 32 is in the rear right of the grader.

Mounted, by supporting members from frame 2 between each two adjacent disks 34 are found scraper blades 50. Scraper blades 50 may be positioned either in fixed distance adjacent to and parallel to bottom tangent line 48 or preferably are vertically movable with respect to bottom tangent line 48. Each of scraper blades 50 extends from a position behind a first cutter disk 32, at an angle ending in front of the next adjacent cutter disk 32.

Preferably an additional lead scraper blade 52 extends from the exterior forward corner of the land grader to in front of the first cutter disk 32 and a trailing scraper blade 54 extends from behind the rearmost cutter disk 32 to a point to the rear exterior of the land grader. It should be observed that although the scraper blades 50, including lead scraper blade 52 and trailing scraper blade 54 are offset one from another, they are substantially parallel in with respect to the direction of travel of the land grader, and the angle of the scraper blades. This is substantially the same angle as an angle defined by a line through the center of the overlapped cutter disks 32.

As previously pointed out, the front of the land grader is supported by front attachment hitch 4 to the tractor. The rear of the land grader is supported by rear wheel support 60. In its preferred form, wheel 60 consists of a rectangular frame 62 whose lower transverse line is wheel axle 64, connected through two vertical support beams 66 to upper support beam 68. Wheel axle 64, which defines the width of rear wheel support 60 is substantially the same width as the transverse rear beam 12, that is, substantially the same width as the overall land grader. Upon wheel axle 64 are closely positioned tamping wheels 70. Each of tamping wheels 70 may be a pneumatic tire of the type adapted for mixed water and air fill as is known in the road grader art. Alternatively, and preferably, the plurality of tamping wheels 70 is replaced by a steel rolling wheel. The entire plurality of tamping wheels 70 forms an essentially cylindrical wheel surface bearing the entire weight of the road grader.

The road grader wheel support 60 is affixed to the road grader through two side pivot points 72. Rear wheel support 60 is pivoted about the side pivot bearings 72 by means of positioning actuator 74, in the preferred version positioning actuator 74 is a hydraulic cylinder affixed to a point upon rectangular frame member 2 extending back and affixed at an actuating end to upper support beam 68. The angle of affixation of the positioning actuator 74 is such that it rotates rear wheel support 60 about pivot bearing 72.

In operation, the land grader is affixed to a tractor and connected through power takeoff 26 so as to permit rotary actuation of the individual cutter disks 32. The vertical height of the land grader is established in the front by the position of the tractor three point hitch 6, which is readily varied in a given tractor. The height of the rear of the land grader is established by the relative position of rear wheel support 60, which, as it rotates about pivot bearing 72 effectively raises or lowers tamping wheels 70 thus raising or lowering the rear beam 12 with respect to the front beam 8 of the land grader. The combination of three point hitch height, and tamping wheel positioning allows the grader to be positioned freely within a range of fore and aft tilts.

The overlap 46 of each cutter disk causes the rearmost cutter disk to be raised relatively more or lowered relatively more than the front most cutter disk by reason of this fore and aft tilt. Since the bottom tangent line 48 of the cutter disks, when rotating, defines the principal surface of cut of the land grader, and since the cutter disks, by reason of their offset, are angled from front to rear, changing the fore and aft tilt causes, in essence, a left to right angle of cut.

In the preferred embodiment, where the foremost cutter disk is on the forward left of the land grader, the grader is normally tilted to a desirable crowning effect in a roadway or roadbed where the left, or center of the road is raised with respect to the right of the road for drainage. It is to be noted that this is accomplished within the structure of the land grader without the necessity of side to side angled positioning means, as would be required with a scraper blade of the prior art.

In use, the angle of the cutter grader being established by raising or lowering the tamping wheels or tractor hitch, power is applied through the power takeoff rotating the cutter blade and the cutter is towed forward over totally unprepared ground. The diamond teeth of each cutter wheel cut and break the ground and debris along the bottom tangent line 48 of the land grader and the resulting spoil is directed by each successive scraper blade 50 into the next rearward adjacent cutter blade where the spoil is further pulverized until finally, the spoil is ejected via the trailing blade 54 to the rear side of the land grader.

The substantial strength of the cutter disks 3 and the large size of the cutter teeth 34 permit a power cut to be made in totally unprepared rocky terrain which, in a single pass, breaks the surface of the soil, throws aside organic debris, and provides a relatively smooth scarified initial surface, properly crowned for drainage.

Since the entire land grader is of a size proportioned to a towing tractor it is of a relatively high maneuverability and thus can be easily used for properly preparing rural roads where the use of a full bulldozer, motor grader combination would be economically unjustified.

The motor land grader further by providing the initial soil cut separating debris from roadbed material, and by proper smoothing and crowning of the road bed in a single pass significantly reduces the preparatory work in preparing a roadbed over new ground.

The land grader therefore provides for an enhanced small road building capability of an efficiency not achievable in the prior art machines.

It should be understood that the particular description given is of a single preferred embodiment and that the scope of the invention extends to that wider range of equivalents as are given in the claims.

I claim:

1. An apparatus for leveling an unprepared soil surface comprising:

first rotary cutter means;

said rotary cutter means rotating transverse to a direction of travel along a soil surface to be prepared;

at least a second rotary cutter means rotating transverse to a direction of travel, and offset laterally from said first rotary cutter means, being further offset along said direction of travel from said first rotary cutter means; and means intermediate said first and second rotary cutters for directing the flow of spoil from said first rotary cutter means into said second rotary cutter means.

2. The apparatus as described in claim 1 above, further comprising:

means for positioning said rotary cutter means vertically with respect to said soil surface;

said means raising and lowering said second rotary cutter a greater relative distance than said first rotary cutter.

3. The apparatus as described in claim 1 above, wherein said means for deflecting spoil further comprises:

said first rotary cutter means and said second rotary cutter means defining a lower tangent line, of cut;

means for raising or lowering said deflection means with respect to said line of cut.

4. An apparatus for grading an unprepared soil surface, for towing behind a tractor having a power takeoff comprising:

frame means, pivotally affixed at a forward end to said tractor; and supported at a rear end thereof by wheel means;

said frame means containing a plurality of rotary cutters, having a direction of rotation transverse to the direction of travel of said frame means;

each said rotary cutter being offset laterally from any adjacent rotary cutters;

each said rotary cutter being offset along the direction of travel from any adjacent rotary cutters, said offset defining an angle of cut;

means between said adjacent rotary cutters for deflecting soil from a first, more forward rotary cutter to a second, more rearward rotary cutter.

5. The apparatus as described in claim 4 above, further comprising:

said wheel means comprising a substantially continuous roller surface transverse to, and substantially as wide as said frame means;

said wheel means being further supported along an axle pivotally affixed to said frame means;

said axle being relatively movable with respect to said frame means;

means for positioning said axle at relative vertical position with respect to frame means.

6. The apparatus as described in claim 4 above further comprising:

means, angularly positioned with respect to the forward most of said rotary cutters for deflecting soil into said foremost rotary cutters;

means behind the rear most said rotary cutter for laterally deflecting spoil external to said frame means.

7. The apparatus as described in claim 4 above, wherein each of said rotary cutters further comprises:

a substantially thick rotary disk;

said rotary disk having an axle for rotation extending from a first bearing point of support approximate the front of said frame means to a second bearing support proximate the rear of said frame means;

means upon said frame means for rotating said axle;

a plurality of web supports extending from said axle to said disk; and a plurality of teeth radially extending from the circumference of said disk.

* * * * *